US005524410A

United States Patent [19]

Menchetti

[11] Patent Number: 5,524,410

[45] Date of Patent: Jun. 11, 1996

[54] FRAMING COMPONENTS OF EXPANDED METAL, AND METHOD OF MAKING SUCH COMPONENTS

[75] Inventor: Robert J. Menchetti, Buffalo, N.Y.

[73] Assignee: National Gypsum Company, Charlotte, N.C.

[21] Appl. No.: 189,051

[22] Filed: Jan. 31, 1994

[51] Int. Cl.[6] ..... E04C 3/09

[52] U.S. Cl. ..... 52/729.2; 29/897.35; 52/635; 52/729.1; 52/729.5; 52/737.1

[58] Field of Search ..... 29/6.1, 897.3, 29/897.35; 52/506.07, 588.1, 634, 635, 662, 670, 671, 673, 675, 730.1, 730.6, 731.7, 729.1, 729.2, 729.3, 729.5, 733.1, 733.2, 733.3, 735.1, 737.1

[56] References Cited

U.S. PATENT DOCUMENTS

| | | | |
|---|---|---|---|
| 593,484 | 11/1897 | Mauser | 52/673 |
| 1,311,820 | 7/1919 | Jones . | |
| 1,644,940 | 10/1927 | Moyer . | |
| 1,741,423 | 12/1929 | Lachman . | |
| 2,141,642 | 12/1938 | Cross . | |
| 2,990,038 | 6/1961 | Diamond . | |
| 3,283,464 | 11/1966 | Litzka . | |
| 3,626,653 | 12/1971 | Amirikian | 52/729 X |
| 3,874,051 | 4/1975 | Malik . | |
| 4,071,995 | 2/1978 | Farmer . | |
| 4,152,873 | 5/1979 | Burke . | |
| 4,545,170 | 10/1985 | Shirey | 29/6.1 X |
| 4,555,889 | 12/1985 | Mankowski . | |
| 4,866,899 | 9/1989 | Houser | 52/729 X |
| 4,894,898 | 1/1990 | Walker | 52/729 X |
| 5,060,352 | 10/1991 | Barker | 29/6.1 |

FOREIGN PATENT DOCUMENTS

| | | | |
|---|---|---|---|
| 391245 | 12/1973 | U.S.S.R. | 52/729 |
| 1609529A1 | 11/1990 | U.S.S.R. . | |

*Primary Examiner*—Carl D. Friedman
*Assistant Examiner*—Kevin D. Wilkens
*Attorney, Agent, or Firm*—Marshall, O'Toole, Gerstein, Murray & Borun

[57] ABSTRACT

An elongated metal structural member including an expanded metal web formed by severing a metal strip along a sinuous path forming a plurality of keystone-shaped tabs on each half, moving the two halves directly away from each other until outer corners of the tabs of one half overlap outer corners of the tabs of the other half, and affixing together the outer corners of one half with outer corners of the other half.

10 Claims, 2 Drawing Sheets

FRAMING COMPONENTS OF EXPANDED METAL, AND METHOD OF MAKING SUCH COMPONENTS

FIELD AND BACKGROUND OF THE INVENTION

This invention relates to novel, expanded metal framing components such as a metal framing stud, and to the method of making such a component.

It has been recognized in the past that metal structural members having a central web portion, such as the common formed sheet metal I-studs and C-studs, floor and ceiling tracks, etc., can be made with less metal, and thus at less cost and weight, by eliminating part of the material in the web. One method of this nature is by cutting and expanding the metal of the web.

An example of a structural member having an expanded web is disclosed in U.S. Pat. No. 3,283,464, wherein the web of a member is cut longitudinally into two parts along a sinuous path, thereby forming two matched halves having a serrated cut edge. After cutting, the two halves are placed together with the high points of each cut edge abutting each other, and the high points are attached as by welding. In the above patent, the process necessitates shifting one of the two halves lengthwise relative to the other half in order for the high points to abut each other. In a continuous manufacturing process wherein a very long strip of metal is cut and formed, this shifting requires an additional somewhat complicated step in the overall process. A further disadvantage is that only small areas of the cut edges of the two halves are in engagement.

SUMMARY OF THE INVENTION

The present invention comprises the method of cutting the web of a metal structural member into two parts along a sinuous path, the sinuous path involving turns of over 90°, thereby forming a series of alternating keystone or dovetail-shaped sections on each half of the web. The two halves are then moved straight apart until the outer corners of the sections of the webs are overlapped, and these overlapping corners are then secured together as by welding or by folding to form an interlocking connection.

It is therefore an object of the invention to provide a more simplified method of reducing the metal in a web section of a structural member.

It is a further object to provide a novel, economical, metal structural member.

BRIEF DESCRIPTION OF THE DRAWINGS

These and other objects and advantages of the invention will be more readily apparent when considered in relation to the preferred embodiments as set forth in the specification and shown in the accompanying drawings, in which.

DETAILED DESCRIPTION OF THE INVENTION

Figure 1:
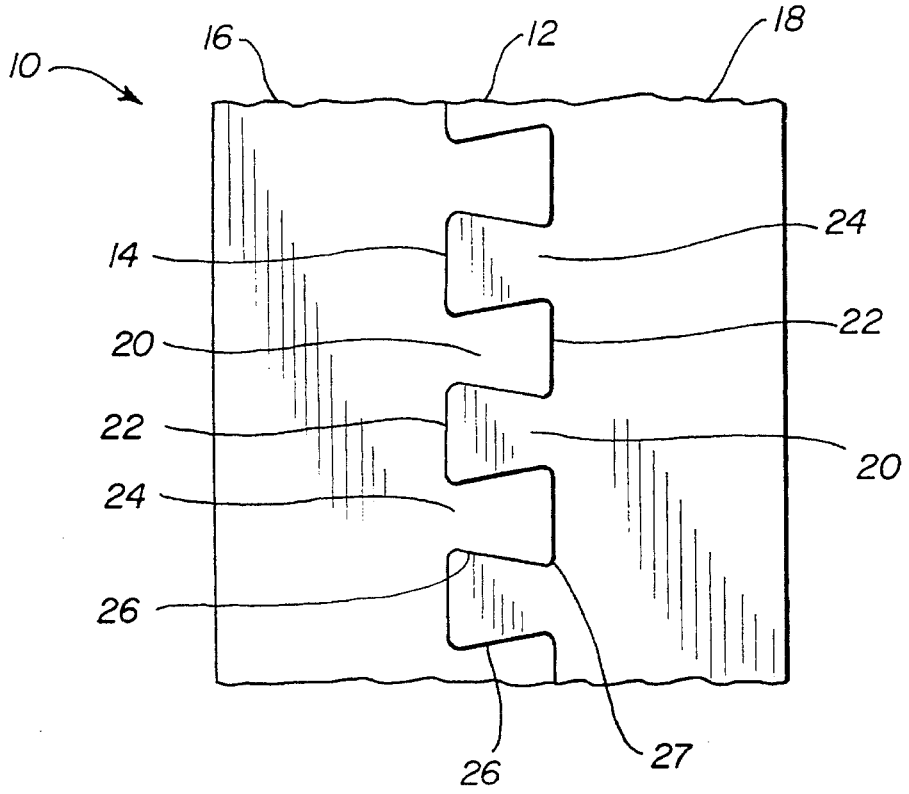
FIG. 1 is a side view of a strip of sheet metal, prior to being formed into an I-stud, showing the path in the cut of the web, in accordance with the present invention.

Referring first to FIG. 1, there is shown an elongated strip 10 of sheet metal. The strip 10 has a width sufficient to form a sheet metal stud, such as an I-stud or a C-stud and includes an elongated center portion 12, suitable for forming the web portion of the metal stud.

The center portion 12 is cut along a continuous, sinuous shear line 14. In accordance with this invention, the center portion 12 is severed along the shear line 14 to create two substantially identical halves 16 and 18, each half including a series of longitudinally spaced dovetail or keystone-shaped tabs or sections 20 and all of the tabs 20 of the two identical halves 16 and 18 are substantially identical.

Each tab 20 has an outer edge 22 which has a greater longitudinal dimension than that of the tab inner end 24. Each tab further has two side edges 26, each of which is angled outwardly from the inner end 24 to the outer edge 22. In a specific example of the invention, each tab 20 is 1¾ inches deep (measured laterally of the length of the strip), has an outer edge 22 that is 3 inches wide and has an inner end 24 that is 1 inch wide. These dimensions form a repeating pattern every 4 inches, and form a gap 23 (FIG. 2) between the outer ends of adjacent tabs of about 1 inch.

Figure 2:
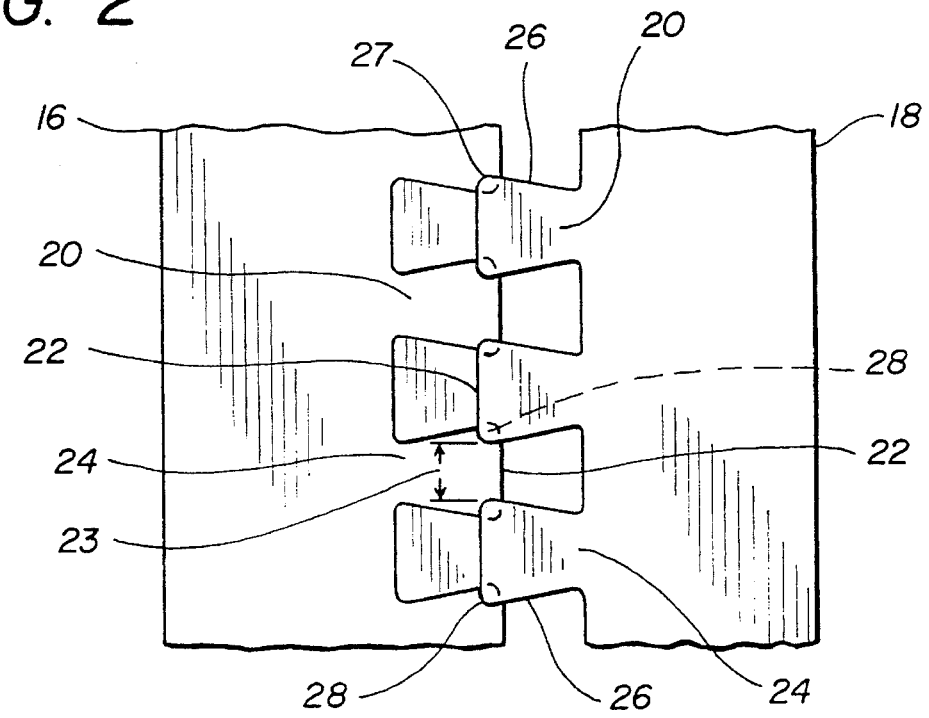
FIG. 2 is a side view of the strip of metal of FIG. 1 with the two halves moved apart.
Figure 3:
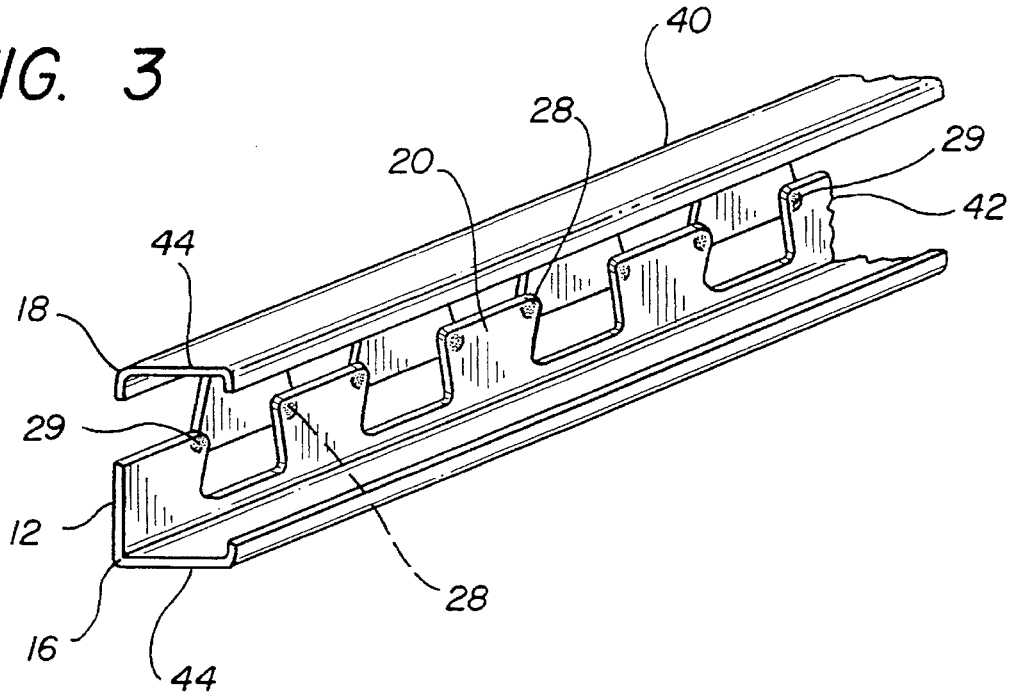
FIG. 3 is a perspective view of a C-stud formed from the strip of FIGS. 1 and 2, with the two halves welded together at overlapping portions.

Referring now to FIG. 2, the two substantially identical halves 16 and 18 will be seen to have been moved laterally directly away from each other, which can be easily accomplished with continuous sheet metal forming equipment. The two halves are moved apart only to the extent that the corner portions 28 of tabs 20 of one half 16 overlap the corner portions 28 of the tabs 20 of the other half 18. The overlapping corner portions 28 are the small areas at the junctions of the side edges 26 and the outer edges 22 of each tab 20 and as illustrated in FIG. 3, the overlapping corner portions 28 are in separate parallel planes. The overlap in the above specific example is about ⅜ inch.

With the two halves 16 and 18 in the partially moved apart positions of FIG. 2, the two halves are secured at the overlapping corner portions 28, and the secured halves are roll-formed to produce an end product such as an I-stud or a C-stud.

Referring to FIG. 3, an expanded C-stud 40 is shown. The corners 28 of one half 16 are welded (such as spot welding) as indicated by the numeral 29 to the corners 28 of the other half 18, forming a rigid, expanded web 42. The strip is then roll-formed to shape the flanges 44 to complete the expanded web C-stud 40.

Figure 4:
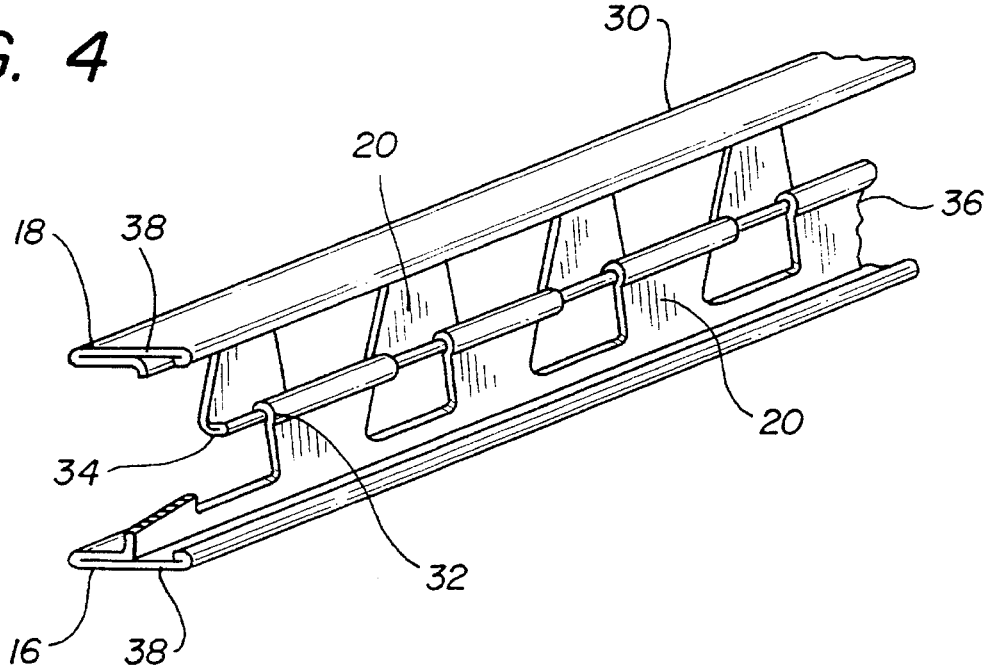
FIG. 4 is a perspective view of an I-stud formed from the strip of FIGS. 1 and 2, with the overlapping portions of the two halves roll-formed in a manner such as to attach the two halves.

An expanded I-stud 30 is shown in FIG. 4, which is formed by moving the two stud halves 16 and 18 directly apart from one another, until only the corner portions 28 overlap, as previously described. The overlapping corner portions 28 are only large enough to permit affixing together of the abutting, overlapping corner portions 28.

In forming the expanded I-stud 30, the abutting, overlapping corner portions 28 are affixed together by forming U-shaped reverse bends 32 and 34 along the outer edges 22 of all of the tabs 20. The reverse bend 32 of the half 16 is a larger, relatively open-bend, and it grasps within it the relatively smaller reverse bend 34, at the overlapping corner portions 28. By crimping the material of reverse bends 32 and 34 very tightly together, a rigid, expanded web 36 is created. The flanges 38 are then roll-formed to the shape of the expanded web I-stud 30.

Expanded I-stud 30 and expanded C-stud 40 each provide a savings of up to about 25% in steel compared to a standard I-stud or C-stud of similar gauge steel and similar basic dimensions. The expanded studs can be formed from sheet steel of various thicknesses, preferably from about 25 gauge up to about 16 gauge. The angle between the outer edges 22 and the side edges 26 is preferably about 60°, and the corners 27 of the tabs are preferably slightly rounded. A typical expanded I-stud 30 or expanded C-stud 40 according to the specific example set out herein has an expanded width of between about 2½ and 4½ inches. A standard prior art 3⅝ inch C-stud requires a 6.4 inch wide strip of steel. The expanded web C-stud 50, according to this invention, requires a 5.275-inch wide strip, a savings of 18%.

The resulting expanded web of I-stud 30 or C-stud 40 contains truss-like diagonals, providing a very efficient design in maintaining structural performance. The sound transmission and heat transmission of I-stud 30 and C-stud 40 are substantially lower than standard I-studs and C-studs.

The invention is equally applicable to floor and ceiling tracks, ceiling grid systems and other roll-formed, elongated, metal structural elements.

Having completed a detailed disclosure of the preferred embodiments of my invention so that those skilled in the art may practice the same, I contemplate that variations may be made without departing from the essence of the invention or the scope of the appended claims.

What is claimed is:

1. A metal structural member comprising an elongated web, said web including two substantially straight identical halves, each of said halves having a plurality of outwardly extending spaced tabs and said tabs of said identical halves being identical, each of said tabs having an outer edge and said outer edges of adjacent tabs being separated by a gap, said outer edge being wider than said gap between said adjacent tabs, said tabs further having side edges, each side edge and outer edge of each tab forming a corner, said corners of one of said two halves overlapping said corners of the other of said two halves and said overlapping corners being in separate parallel planes, and said overlapping corners being rigidly affixed together to form an expanded web.

2. A metal structural member as defined in claim 1, wherein said member comprises a steel stud including, in addition to said expanded web, spaced, parallel flanges on each side of said web.

3. A metal structural member as defined in claim 2, wherein said stud is a C-stud.

4. A metal structural member as defined in claim 2, wherein said stud is an I-stud.

5. A metal structural member as defined in claim 1, wherein said corners of one of said halves are welded to corners of the other of said halves.

6. A metal structural member as defined in claim 1, wherein said member is formed of from about 25-gauge to about 16-gauge sheet metal.

7. A metal structural member as defined in claim 1 wherein said tabs have a depth of about 1¾ inches, and said two halves overlap about ⅜ inch at said corners.

8. A metal structural member as defined in claim 1, wherein said tab outer edges are about 3 inches wide, and said gap between said outer edges is about 1 inch.

9. A metal structural member as defined in claim 8, wherein said structural member comprises a steel stud with spaced parallel flanges on each side of said web, said steel being from about 25-gauge to 16-gauge sheet metal and said tabs being about 1¾ inches deep with said corners of said tabs overlapping about ⅜ inch.

10. A metal structural member comprising an elongated web, said web including two substantially identical halves, each of said halves having a plurality of outwardly extending spaced tabs, each of said tabs having an outer edge and said outer edges of adjacent tabs being separated by a gap, said outer edge being wider than said gap between said adjacent tabs, said tabs further having side edges, each side edge and outer edge of each tab forming a corner, said corners of said two halves being rigidly affixed together to form an expanded web, said corners being affixed together by reverse bends along said outer edges, said reverse bends of one of said halves grasping therein said reverse bends of the other of said halves, with said reverse bends being tightly crimped.

* * * * *